US010350615B2

(12) United States Patent
Eberle et al.

(10) Patent No.: US 10,350,615 B2
(45) Date of Patent: Jul. 16, 2019

(54) CENTRIFUGE WITH GASEOUS COOLANT CHANNEL

(71) Applicant: ANDREAS HETTICH GMBH & CO. KG, Tuttlingen (DE)

(72) Inventors: Klaus-Guenter Eberle, Tuttlingen (DE); Matthias Hornek, Tuttlingen (DE); Robert Hegele, Ravensburg (DE)

(73) Assignee: ANDREAS HETTICH GMBH & CO. KG, Tuttlingen (DE)

( * ) Notice: Subject to any disclaimer, the term of this patent is extended or adjusted under 35 U.S.C. 154(b) by 184 days.

(21) Appl. No.: 15/246,354

(22) Filed: Aug. 24, 2016

(65) Prior Publication Data

US 2017/0056893 A1 Mar. 2, 2017

(30) Foreign Application Priority Data

Aug. 27, 2015 (DE) ..... 10 2015 216 447

(51) Int. Cl.
*B04B 15/02* (2006.01)
*B04B 7/02* (2006.01)
*B04B 7/06* (2006.01)

(52) U.S. Cl.
CPC ..... *B04B 15/02* (2013.01); *B04B 7/02* (2013.01); *B04B 7/06* (2013.01)

(58) Field of Classification Search
CPC ..... B04B 7/02; B04B 15/02; B04B 7/06
USPC ..... 494/13, 14, 60
See application file for complete search history.

(56) References Cited

U.S. PATENT DOCUMENTS 2,699,289 A * 1/1955 Allen ..... B04B 5/0414 464/89
2,917,229 A * 12/1959 Di Benedetto ..... B04B 5/0414 494/14
3,148,146 A * 9/1964 Asnes ..... B04B 5/0414 220/378

(Continued)

FOREIGN PATENT DOCUMENTS

CN 101455999 6/2009
CN 202191968 4/2012

(Continued)

OTHER PUBLICATIONS

Machine translation of CN 202191968 published Apr. 2012.*

(Continued)

*Primary Examiner* — Charles Cooley
(74) *Attorney, Agent, or Firm* — Woodling, Krost and Rust

(57) ABSTRACT

A centrifuge (10) comprising a housing (12), a rotor (32), a safety vessel (26) in which the rotor (32) is supported on a drive shaft (37) extending through the safety vessel (26) and a centrifuge cover (16) limiting an inner space (24) of the housing (12), wherein the safety vessel (26) is provided in the inner space (24), a gaseous coolant enters the inner space (24) via a suction opening (20), flows through the inner space (24), thereby guided laterally past the safety vessel (26) and at least sectionally past the drive motor via the rotor (32), and laterally exits the inner space (24) of the housing (12) through an outlet opening (46). The invention is characterized by a channel (41) being provided for the gaseous coolant, running around the safety vessel (26) at least in part and formed by the safety vessel (26) and at least one flow guidance (40), provided in radial direction.

4 Claims, 5 Drawing Sheets

(56) References Cited

U.S. PATENT DOCUMENTS

| | | | | | |
|---|---|---|---|---|---|
| 3,339,836 | A * | 9/1967 | Mitchell | B04B 5/0414 494/16 |
| 3,860,166 | A * | 1/1975 | Anderson | B04B 15/02 494/10 |
| 4,221,325 | A * | 9/1980 | Kubota | B04B 5/0414 494/14 |
| 5,490,830 | A * | 2/1996 | Lovelady | B04B 5/0421 494/14 |
| 5,772,572 | A * | 6/1998 | Koch | B04B 7/02 494/14 |
| 7,192,394 | B1 * | 3/2007 | Karl | B04B 15/02 494/14 |
| 7,371,205 | B2 * | 5/2008 | Andersson | B01L 7/54 494/14 |
| 8,734,310 | B2 * | 5/2014 | Janzen | B04B 15/02 494/14 |
| 9,993,830 | B2 * | 6/2018 | Goellnitz | B04B 7/02 |
| 10,213,792 | B2 * | 2/2019 | Eigemeier | B04B 7/02 |
| 2005/0043163 | A1 * | 2/2005 | Malugvist | B01L 7/52 494/14 |
| 2006/0142134 | A1 * | 6/2006 | Andersson | B01L 7/54 494/14 |
| 2010/0179043 | A1 | 7/2010 | Janzen | |
| 2011/0294642 | A1 * | 12/2011 | Murayama | B04B 5/0421 494/14 |
| 2017/0056893 | A1 * | 3/2017 | Eberle | B04B 7/06 |

FOREIGN PATENT DOCUMENTS

| | | | | |
|---|---|---|---|---|
| CN | 101862707 | | 6/2015 | |
| DE | 19615702 | | 10/1997 | |
| DE | 10316897 | | 11/2004 | |
| DE | 10355179 | | 6/2005 | |
| DE | 102009004748 | | 12/2010 | |
| EP | 455876 | A2 * | 11/1991 | |
| EP | 3135381 | A1 * | 3/2017 | |
| GB | 925665 | A * | 5/1963 | B04B 5/0414 |
| JP | S54132065 | | 9/1979 | |
| JP | 02280853 | A * | 11/1990 | B04B 15/02 |
| JP | 2008284517 | | 11/2008 | |
| JP | 2008307219 | | 12/2008 | |
| JP | 2009240978 | A * | 10/2009 | B04B 15/02 |
| JP | 2010172889 | | 8/2010 | |
| JP | 5007956 | B2 * | 8/2012 | B04B 15/02 |

OTHER PUBLICATIONS

German Patent and Trademark Office, Search Report, dated May 19, 2016, pp. 1-9, Application No. 102015216447.0.

Japan Patent Office, Notification of Reason for Refusal, dated Feb. 27, 2018, pp. 1-3, Patent Application No. 2016-161950.

Japan Patent Office, Translation of Notification of Reason for Refusal, dated Feb. 27, 2018, pp. 1-2, Patent Application No. 2016-161950.

European Patent Office, Search Report, dated Jan. 19, 2017, pp. 1-7, Application No. 16182783.7, Applicant: Andreas Hettich GMBH & CO. KG.

The State Intellectual Property Office of P.R. China, First Office Action, dated May 16, 2016, pp. 1-4, Application No. 201610752899.1.

The State Intellectual Property Office of P.R. China, Translation of the First Office Action, dated May 16, 2018, p. 1-8, Application No. 201610752899.1.

* cited by examiner

CENTRIFUGE WITH GASEOUS COOLANT CHANNEL

This patent application claims priority to German patent application no. DE No. 10 2015 216 447.0, filed Aug. 27, 2015. German patent application no. DE No. 10 2015 216 447.0, filed Aug. 27, 2015, is incorporated herein by reference hereto in its entirety.

BACKGROUND OF THE INVENTION

Field of the Invention

The invention relates to a centrifuge.

Description of the Related Art

In centrifuges, in particular laboratory centrifuges, often times sample material is centrifuged, which material is sensitive to temperature. Conventionally, a certain temperature, 37° C. for example, is not to be exceeded upon centrifugation of biological material, as otherwise the material properties change.

During operation of the centrifuge, heat is generated due to friction between rotor and air contained in the inner space of the centrifuge. Said heat can be dissipated by means of indirect cooling. If sample temperatures below ambient temperature are to be achieved, installation of a cooling facility is required and heat is extracted from the outside of the safety vessel by means of a coolant. If sample temperatures higher than ambient temperature, e.g. 37° C., are allowed, conventionally ambient air is guided through the centrifuge for heat dissipation. To that end, fans are arranged inside the centrifuge housing and directed to heat-transferring surfaces, such as the outside of the safety vessel. However, this type of cooling requires strong flows of air to dissipate the amounts of heat, which is technically elaborate and causes high noise emission. Therefore, the indirect cooling is mainly suitable for centrifuges having a low driving performance.

In bigger centrifuges having no cooling facility installed, usually direct cooling ensues. In JP 2008284517 A or JP 2008-307219 A for example, a centrifuge is disclosed in which air is suctioned from the environment via a recess in a centrifuge cover. A rotor arranged in a safety vessel acts similar to a fan wheel during operation of the centrifuge. A negative pressure is created in the region of the rotational axis of the rotor. Air from above the rotor is suctioned and displaced by subsequently flowing air, flows in the inner space of the centrifuge, thereby circumventing the safety vessel, as well as a drive motor arranged below the safety vessel and exits the inner space by an outlet opening on a rear side of the centrifuge.

This solution is cost-effective and simple. However, there is a considerable noise emission, as the air contained in the housing flows in undefined courses, air separation edges develop and the air exits the housing the shortest way, following the smallest resistance. Here, sound generated inside the centrifuge during operation enters to the outside in an unobstructed fashion or develops at the air separation edges. Furthermore, the air does not mandatorily distribute in the inner space of the centrifuge in a uniform manner, in particularly not at the safety vessel in a targeted manner. Therefore, a uniform heat removal on the safety vessel and drive motor is not guaranteed.

DE 103 55 179 A1 and DE 103 16 897 A1 disclose air-cooled centrifuges in which air is suctioned into the space via the cover, and discharged into a channel located in the centrifuge housing. The channel is configured in such a way as to lead perpendicularly downwards on the outside of the vessel.

However, the disadvantage of said solutions is that the air only flows over a minimum outside area of the safety vessel und thus almost no heat dissipation can take place with air deflections of at least 90° occurring in the region of the safety vessel, thereby leading to the emission of sound.

SUMMARY OF THE INVENTION

It is the object of the invention to further develop a centrifuge and avoid the above mentioned disadvantages in such a way that uniform heat dissipation is effected at the safety vessel and the drive motor within the housing, in particular the emission of sound shall be reduced.

The invention is based on the knowledge that flow can be calmed and directed to the heat-transferring areas in a targeted manner by a defined flow guidance of the cooling medium, such that by the additional use of the external surface of the safety vessel as heat transferring surface, the air flow can be reduced with constant cooling effect and thus sound emission of the centrifuge can considerably be reduced.

According to the invention, a channel is provided for the gaseous coolant, running around the safety vessel at least in partial sections in a helical manner and forming at least one flow guidance, limiting the channel in the radial und axial directions at least sectionally so that at least in the region of the safety vessel a directed flow is created in the direction around the safety vessel (26). The coolant is continuously discharged from a flow turbulent in the region of the suction opening, into a laminar flow, resulting in a significant decrease of sound emission. In addition, the course of the coolant flow can be controlled such that a bigger area of the outer wall of the safety vessel is flown over than it would be the case with an undirected flow. This ensures a more efficient cooling of the centrifuge. The centrifuge is therefore more suitable for use in small spaces or in direct proximity to the operator.

It is advantageous for the channel to extend just until below the safety vessel. In smaller construction heights, flow guidance is designed multi-course in the region of the safety vessel. In particular, said flow guidance has a constant slope.

The suction opening is advantageously arranged within the centrifuge cover with the coolant axially entering the inner space. This way, the suction opening and the supply of ambient air may be structurally integrated in the centrifuge in a simple manner, thereby saving costs.

In one embodiment, it has proven to be advantageous to arrange a suction opening below the rotor. This enables further design options, in particular in terms of external air supply.

It is advisable for the flow guidance to be configured as a separate component relative to the housing. This allows using various cost-effective materials for producing the flow guidance and an installation into the centrifuge adapted to the respective requirements. As a result, costs are saved and efficiency in cooling the safety vessel is increased.

In order to simplify repair and maintenance and allow exchanging the flow guidance with one having a different configuration, if required, it is advantageous for the flow guidance to be connected to the housing in a releasable manner.

It is advantageous for the flow guidance to have a U-shaped, semicircular or V-shaped cross-section. This way, flow resistances in the channel are minimized, and the coolant is calmed faster. The noise emissions may therefore be further reduced.

Heat removal is particularly efficient if the flow guidance is placed onto the vessel. The flow guidance has the effect of additional cooling elements, if said guidance is formed of conductive material. The flow guidance thus further increases the heat-transferring area.

In an advantageous configuration, the flow guidance, in particular as part of a housing insert, closely abuts the safety vessel. Here, the coolant flows into the channel limited from all sides, with the boundary being formed by the safety vessel and the flow guidance. The flow of coolant may thus be controlled even more exactly, and the coolant flows directly over the safety vessel to be cooled, which vessel is usually made of metal and thus has a good heat conductivity. Also, installation is considerably facilitated along with an appropriate design of the flow guidance, in particular if the flow guidance forms part of a housing insert. The flow guidance forms a channel at least in the region of the safety vessel, which channel runs helically downward in the housing at least sectionally, i.e. with an inclination angle and at a constant distance to the rotor axis. This way, the coolant can circumvent almost over the entire surface at the outer wall of the safety vessel. This further increases the cooling efficiency.

In particular, the flow guidance has a helically-running design at least in the region around the safety vessel, which design can be one-way or multiway. The inclination is constant or increasing. Therefore, the flow of coolant is calmed over a long distance. Noise emission of the centrifuge is further reduced.

According to another aspect of the invention, the inclination, the surface design of the flow guidance and the cross-section of the channel are formed such, that a laminar flow of coolant is created in the channel. Thereby, in particular the way of the coolant is extended und thus the friction resistance increased, such that the speed of the coolant is reduced. As a result, noise emission is reduced.

In a preferred embodiment, the flow guidance forms an enlarging channel cross-section, at least in the region of the safety vessel. This also serves for the reduction of noise emission, as the channel cross-section continuously increases in direction toward the outlet opening, resulting in a reduced flow speed. This has a positive effect on the ease of operation of the centrifuge.

In a preferred embodiment, flow guidance is formed by at least one molded part which is in particular configured as a housing insert. This allows flexible insertion and replacement of flow guidance and thus facilitates installation.

The molded part is advantageously made of foam, such as PUR, EPP; EPE or EPS. Molded foam parts can be exactly produced in the desired shaped, provide sound-blocking properties, are elastic and relatively cost-effective.

Besides the already-described effect of reduced flow noise by decreasing flow speed, also the—at least partial—enclosure of the noise-emitting components such as motor and rotor by means of the molded part allows for a noise encapsulation. In particular in the configuration in which the flow guidance is guided helically around the safety vessel, the molded part acts as a noise blocker. Sound waves starting at the inside of the centrifuge or developing by the flow of coolant in the channel as well as soundwaves reflected at the outside of the safety vessel are directly absorbed in the channel to the upper side, the lower side and the outside in the molded part.

According to another aspect of the invention, the safety vessel is mounted in the molded part/the molded parts by a clamping connection. This way, other mounting or fixing elements for the safety vessel can be omitted at least partially. In this case, preferably the molded part(s) and thus the housing insert(s) hold the safety vessel. This saves production and maintenance costs of the centrifuge. Clamping the elastic molded parts between housing and safety vessel prevents components from being excited to oscillate and thus from emitting noise. Furthermore, the molded part can readily be introduced into the housing, in particular a part of the molded part abuts the safety vessel in a clamping manner, said vessel laterally sealing the channel and preventing a short-circuiting flow.

Preferably, the cross-section of the outlet opening is at least 150% of the smallest cross-sectional area of the channel. In practice it has been found that flow speed in the region of the outlet opening is reduced, thereby preventing noise emission.

In an advantageous development of the invention, the outlet opening is arranged above the deepest flow course of the coolant when viewed in the axial direction. To that end, the flow guidance is guided from the deepest flow course upwards to the outlet opening such that the coolant flows again in generally the axial direction. This prevents that noises generated by the motor may enter to the outside. This further reduces noise emission of the centrifuge.

It is furthermore very favorable for the outlet opening to be arranged above a drive motor for the drive shaft of the rotor. The above-described noise-isolation effect thus also concerns the drive motor. This allows a particularly efficient reduction of noise emission.

Further advantages, features and application options of the present invention result from the description given below in conjunction with the exemplary embodiments shown in the drawings.

BRIEF DESCRIPTION OF THE DRAWINGS

The terms assigned to and given in the list of reference numerals given below are used in the description, the claims and the drawings. The drawings show in:

DESCRIPTION OF THE INVENTION

Figure 1:
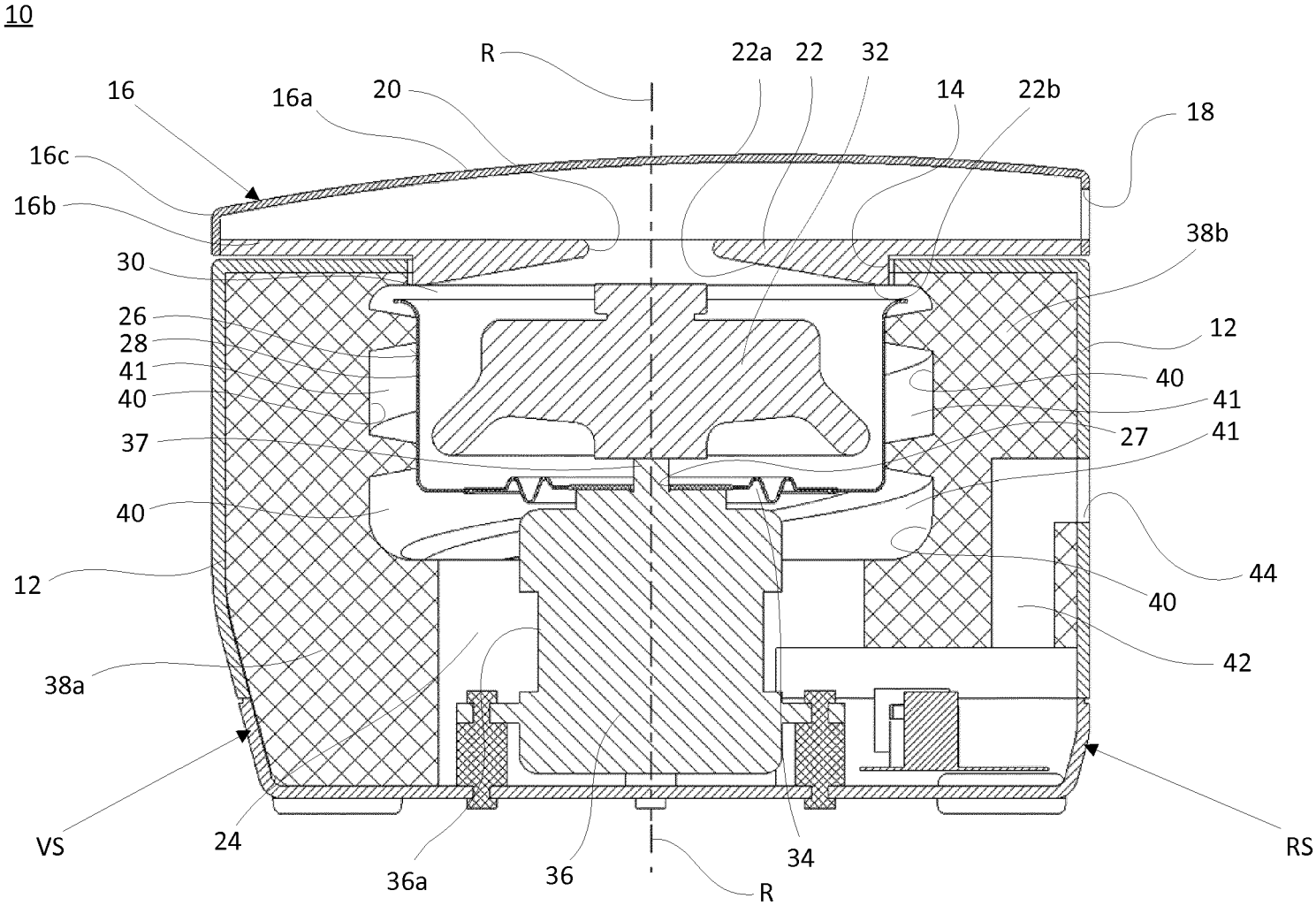
FIG. 1 a lateral sectional view of a centrifuge according to the invention.
Figure 2:
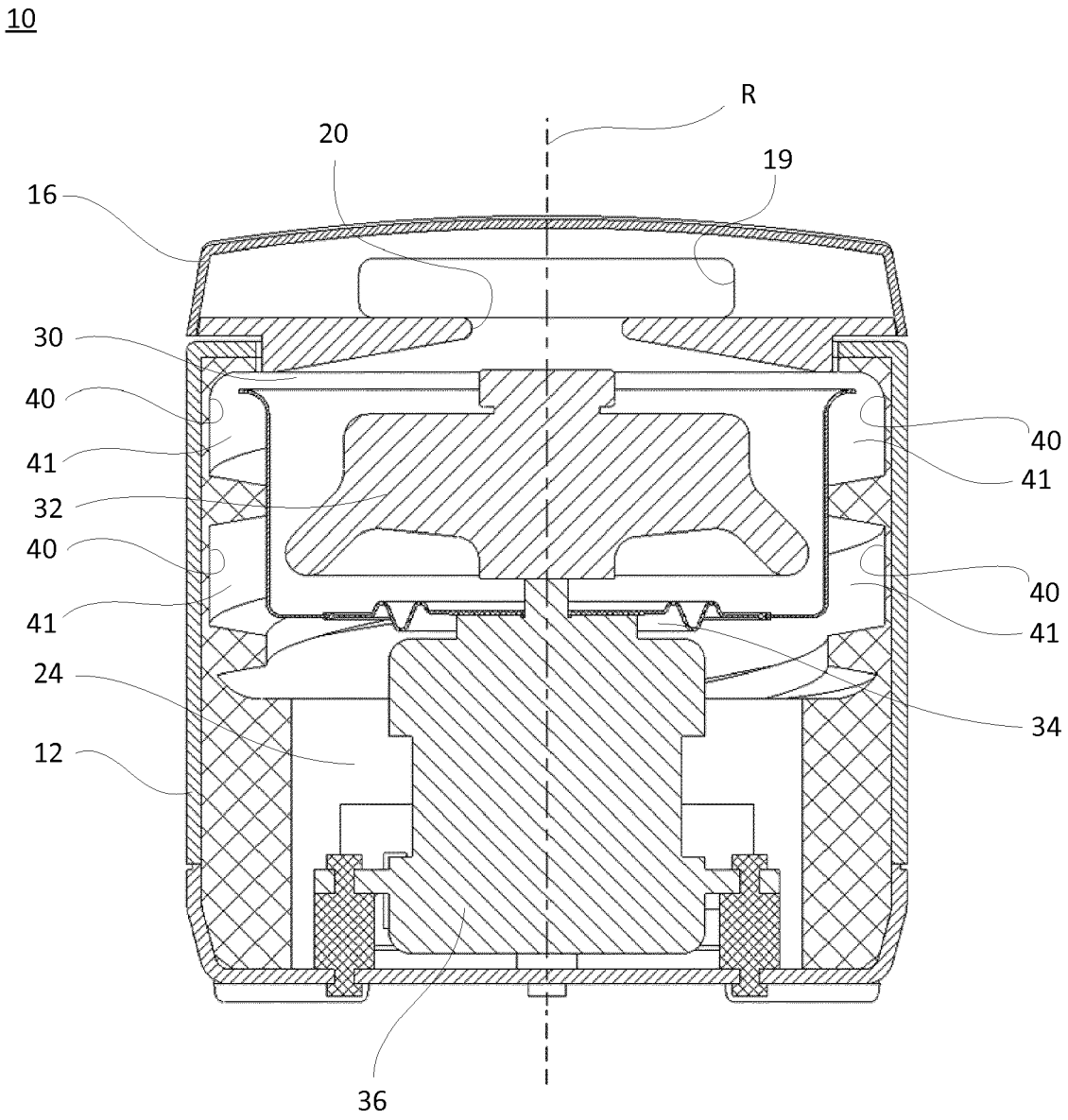
FIG. 2 a sectional view from the front of the centrifuge illustrated in FIG. 1, FIG. 3 a perspective lateral view of a partial section of the centrifuge illustrated in the preceding figures.
Figure 3:
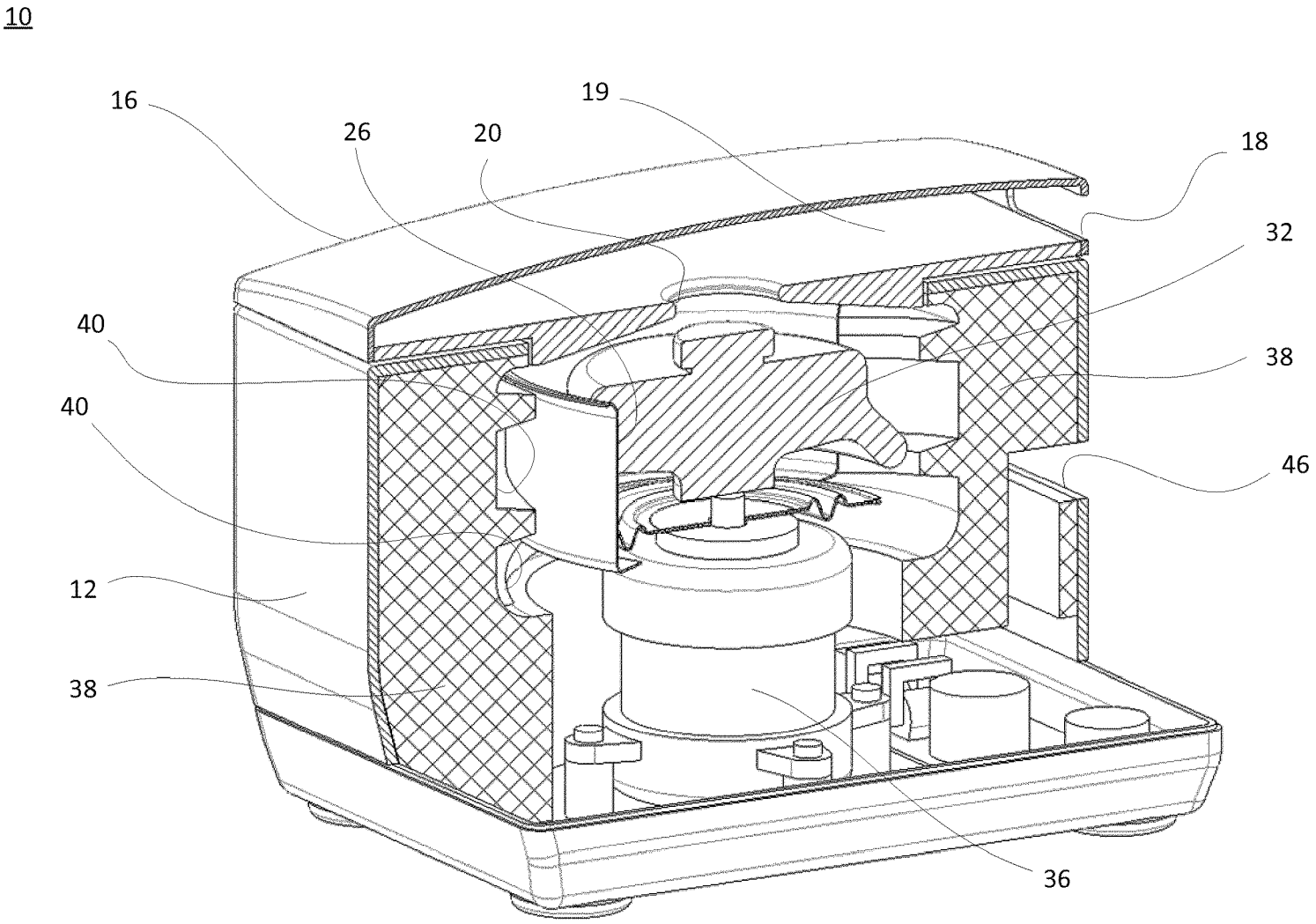

FIG. 1 shows at centrifuge 10 according to the invention in a lateral sectional view, wherein a front side VS of the centrifuge 10, when viewed from the left, points to the left side and a rear side RS points to the right side. FIGS. 2 and 3 show the centrifuge 10 from different perspectives.

The centrifuge 10 is provided with a housing 12. The housing 12, on the top of which is provided a cover 16, delimits an inner space 24 of the centrifuge 10. A drive motor 36 is arranged in the inner space 24, said motor driving the rotor 32 supported on the drive shaft 37 and rotatably mounted to the drive shaft 37 and supported above the drive motor 36. The rotor 32 is surrounded by a rotation-symmetrical safety vessel 26, in order to minimize the risk of damage of the centrifuge 10 in case of a crash or a fraction of the vessel as well as the case of a contamination of the inner space 24 and the environment.

The security vessel 26 is mounted on a motor housing 36*a* surrounding the drive motor 36. The rotor 32, the safety vessel 26 and the drive shaft 37 and drive motor 36 are arranged concentrically to a rotor axis R.

A bellows 34 is provided between safety vessel 26 and motor housing 36*a* for decoupling vibrations occurring during operation. In addition, bellows 34 serves for sealing a recess 27 provided in the safety vessel 26, by means of which the drive shaft 37 engages the safety vessel 26 from below.

A molded part 38 is provided in the inner space 24 of the centrifuge 10, said molded part abutting the housing 12 from all sides at least in some areas. In the region of the safety vessel 26, the internal diameter of the molded part 38 is essentially designed such, that the molded part 38 abuts the vessel wall, whereas a channel 41 running helically around the safety vessel 26 is introduced relative to the rotor axis R, said channel being limited, in some regions, by the guidance 40 of molded part 38. The guidance 40 is configured U-shaped if viewed in cross-section. The channel 41 is thus limited radially to the outside and axially to the guidance 40 of the molded part 38 and radially to the inside by the vessel wall 28. The molded 38 part extends from the lower side of the upper wall region 12*a* of the housing 12, on which the cover 16 is arranged in the closed state, to the base 12*b* of the housing. The molded part 38 completely engages around the safety vessel 26 and usually is set up of two parts which are readily inserted into the housing and form a clamping connection with the security vessel 26. Here, the safety vessel 26 is only held by the molded part 38. Thereby, the channel 41 is sealed on the side of the safety vessel 26.

Guidance 40 is introduced into the molded part 38 and thus the channel 41 circumvents the safety vessel 26. Below the safety vessel, the radial cross-section is gradually reduced until the guidance 40 finally transforms into a cylindrical inner contour 39 of the molded part 38. The diameter of the inner contour 39 approximately corresponds the diameter of the safety vessel 26, with the molded part 38 being arranged at a distance from the motor housing 36*a* and the safety vessel 26.

An opening 42 pointing to the rear side RS is introduced into the inner contour 39, followed by an outlet channel 44. The outlet channel 44 runs starting from the opening 42 first in a first sub-part 44*a* orthogonally to the rotor axis R to the rear side RS and is then guided in parallel to the rotational axis R, neighboring a housing rear wall 12*a* in a second sub part 44*b* until the level of the bellows 34. Here, the outlet channel 44 opens into a discharge opening 44 which is introduced into the housing rear wall 12*a*.

The cover 16 of centrifuge 10 comprises a convex ceiling wall 16*a*, a base wall 16*b* as well as four side walls 16*c*. A suction opening 18 is introduced into the side wall 16*c* facing the rear side RS of centrifuge 10. A suction opening 20 is arranged in the base wall 16*nb* in such a way, that it is concentric to the rotor axis R in the state of the cover 16 being closed. A suction channel 19 connecting the suction opening 18 and the suction opening 20 is introduced into the cover.

An opening 14 is provided in the upper side 12*b* of the housing 12 assigned to the cover 16 concentric to the rotation axis R, the diameter of which is bigger than the diameter of the rotor 32, such that the rotor 32 can easily be loaded and unloaded and replacing and maintaining the rotor 32 can be effected in a simple manner.

A guide region 22 surrounding the suction opening 20 is provided in the bottom wall 16*b* of the cover 16, the guide region engaging the opening 14 of the housing 12 when closing the cover 16. The guide region 22 terminates flush with the bottom wall 16*b* on the side facing the suction channel 19, while running radially oblique downwards on the side facing the rotor 32, when viewed from the rotation axis R. The guide region 22 forms a control surface 22*a* on the side facing the rotor 32.

Air suctioned by the suction opening 18 entering the suction channel 19 flows into the inner space 24 of the centrifuge 10 through the suction opening 20. While part of the inrushing amount of air flows towards the rotor 32 located directly beneath the suction opening 20 in an axial manner, a further part of the amount of air flows toward the vessel wall 28 along the control surface 22*a*, such that the air distributes in a relatively even manner within the safety vessel 26 after entering.

In a way comparable to a fan wheel, the rotor 32 generates negative pressure in the region above the rotor 32 by its rotation during operation, by means of which further air is suctioned from the suctioning channel 19 in the cover 16. The air displaced by the following air coming from the region above the rotor 32 is brought to a helical movement and flows into the guidance 40 through a gap 30 formed between the vessel wall 28 and an edge 22*b* of the control surface 22*a* assigned to the housing 12. Guidance 40 follows a double-threaded, left-hand helical line with a constant slope of 100 mm in the counter-clockwise rotation of the rotor 32. The air is thus guided in a homogenous channel with no air separation edges, and the flow turbulent after entrance of the air into centrifuge 10 is more and more transferred to a laminar flow.

Beneath the safety vessel 26, the air flows out of the guidance 40 into the region of the inner space 24 bounded by the cylindrical inner contour 39 of the molded part 38, in which space the drive motor 36 is arranged. The air flows around the motor housing 36*a*, before passing to the outlet opening 46 through the outlet channel 44, there-through leaving centrifuge 10. By the helical guidance 40, circulation movement of the cooling air is maintained also in the region of the inner space 24 bounded by the cylindrical inner contour 39 of the molded part 38. Thereby, the motor housing 36*a* is as well streamed in a circumferential direction of motor housing 36*a* and therefore the cooling effect is improved.

It is as well conceivable to dispense with the second sub-part 44*b* of the outlet channel 44, to guide the first sub-part 44*a* until the housing 12, to provide the outlet opening 46 there and to discharge air from there from the centrifuge 10. However, configuration of the second sub-part 44*b* as well as the offset arrangement of the discharge opening 46 relative to the first sub-part 44*a* improve noise cancellation. The soundwaves of the motor and of the air induced to rotate in the centrifuge 10 by the rotation of the rotor 32 are better absorbed by the molded part 38 by means of this configuration as in case of a straight-line guidance of outlet channel 44.

In the exemplary embodiment illustrated in FIGS. 1-3, it is assumed that a relatively low cooling performance is required, such that ambient air is used as cooling medium. Depending on the field of application, said air could actively be cooled even prior to entering suction opening 18, or carbon dioxide or nitrogen could be chosen as coolants.

Figure 4:
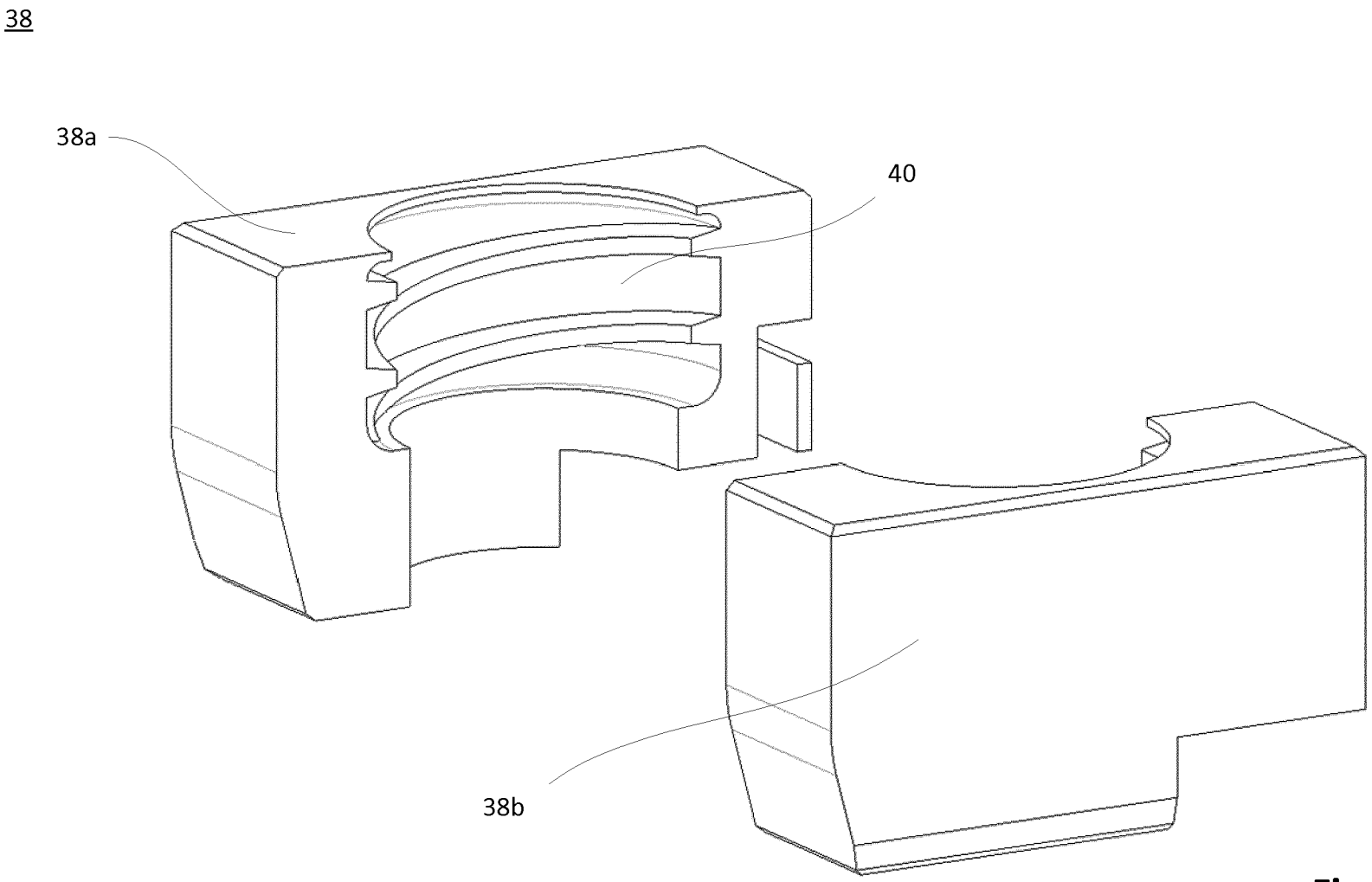
FIG. 4 a perspective view of a molded part in divided design.

FIG. 4 shows a perspective view of a molded part 38 in divided design with two asymmetrically configured halves, with the rear halve being the rear halve 38*a* of the molded part and the front halve being the front halve 38*b* of the molded part. The divided design facilitates introduction of the molded part 38 into the housing 12 of the centrifuge 10 and installation as a result. Thus, molded part 38 forms a housing insert.

Due to the good noise-cancellation properties, molded part 38 is made of PUR. Further foam materials, such as EPP, EPE and EPS are suitable as well.

The helical arrangement of guidance 40 can well be discerned here.

Figure 5:
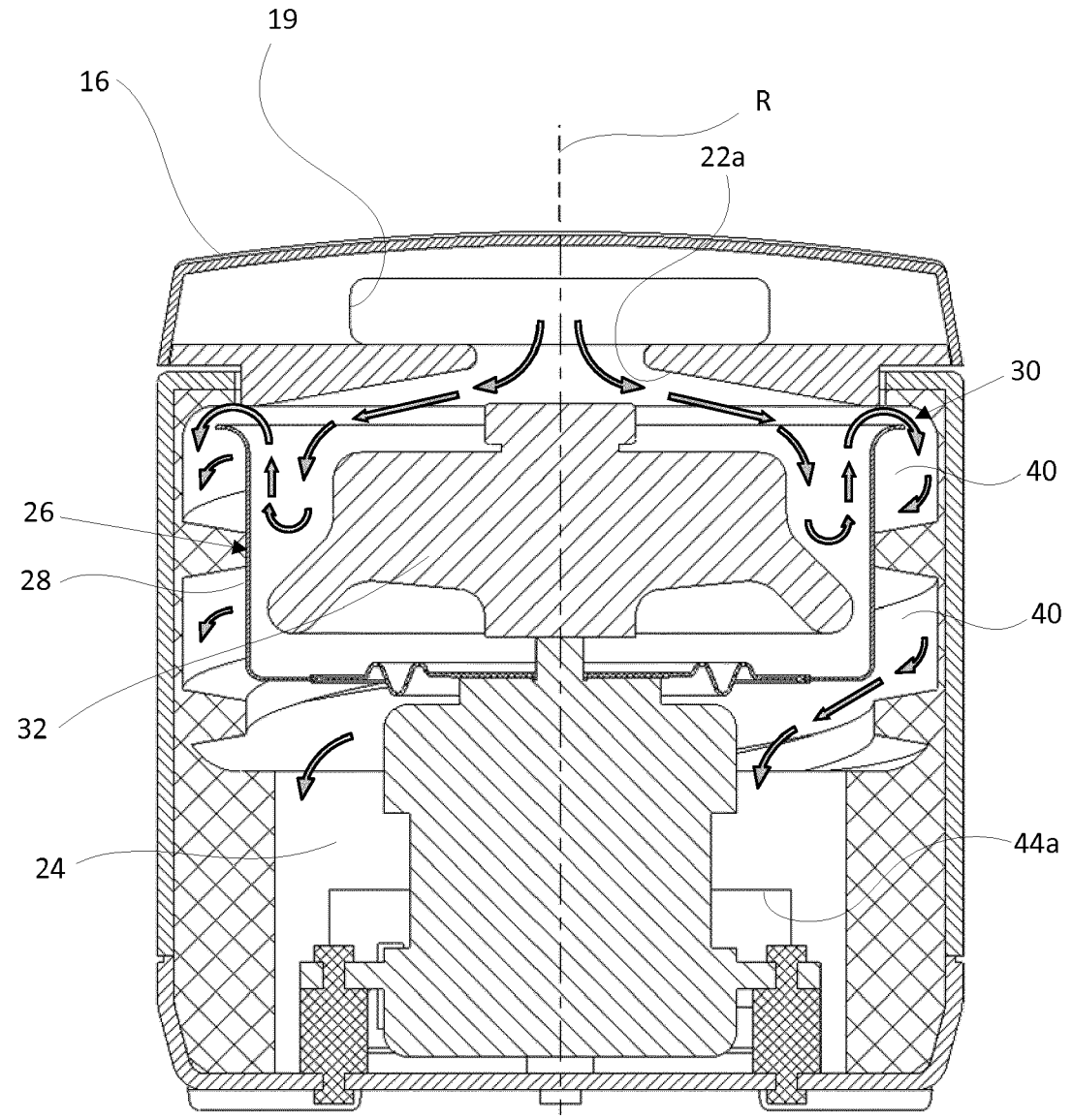
FIG. 5 the sectional view of the centrifuge shown in FIG. 2 from the front with a schematic illustration of the air flow within the centrifuge.

FIG. 5 shows the sectional view of centrifuge 10 illustrated in FIG. 2 from the front in a schematic illustration of the flow of air within the centrifuge 10.

The air for cooling enters from the outside via the suction opening 18 (not discernable here) into the suction channel 19 arranged in the cover 16. The air flows into the safety vessel 26 via the suction opening 20 and is distributed in the region between rotor 32 and control surface 22*a* provided at the lower side of the cover 16. The air flows around the rotor 32 in sections while absorbing heat, and then reaches the guidance 40 through the gap 30.

The air is calmed within the guidance 40 arranged around the safety vessel 26 in a helical manner, due to the uniform channel shape and the constant inclination angle and progressively transferred into a laminar flow. In this case, the air absorbs heat from the vessel wall 28.

Depending on which location relative to the circumferential angle of the safety vessel 26 the air has flown into the guidance 40, it reaches the guidance 40 in the inner space 24 of centrifuge 10 located beneath the safety vessel 26 after about 0.5 to 2 rotations about the safety vessel 26, where it flows around the motor housing 36*a* of drive motor 36, taking heat therefrom as well.

Finally, the air enters into the first sub-part 44*a* of outlet channel 44, which part, as described above, runs orthogonally to the rotor axis R, and furthermore to a second sub-part 44*b* (not to be discerned from this perspective), arranged in parallel to the rotor axis R. Via the outlet opening 46 (also not to be discerned in FIG. 5) the heat-transporting air is blown out of the centrifuge 10.

LIST OF REFERENCE NUMERALS

10 centrifuge
12 housing
12*a* housing rear wall
14 opening
16 cover
16*a* ceiling wall
16*b* bottom wall
16*c* side walls
18 suction opening
19 suction channel
20 suction opening
22 guide region
22*a* control surface
22*b* edge
24 inner space
26 safety vessel
27 recess
28 vessel wall
30 gap
32 rotor
34 bellows
36 drive motor
36*a* motor housing
37 drive shaft
38 molded part
38*a, b* halves of molded part
40 guidance
41 channel
42 recess
44 outlet channel
44*a* first sub-part
44*b* second sub-part
46 outlet opening
R rotor axis
VS front side
RS rear side

The invention claimed is:

1. Centrifuge (10), comprising:
a housing (12);
said housing includes an inner space (24);
a rotor (32);
a safety vessel (26);
a drive shaft (37);
a drive motor;
said rotor (32) is supported on said drive shaft (37) and extends through said safety vessel (26);
a centrifuge cover (16) limiting said inner space (24) of said housing (12);
said centrifuge cover includes a bottom wall (16*b*);
said bottom wall of said centrifuge cover includes a suction opening (20);
said safety vessel (26) resides in said inner space (24);
a gaseous coolant enters said inner space (24) through said suction opening (20) of said bottom wall of said centrifuge cover and flows through said inner space (24) and is thereby guided laterally past said safety vessel (26) and at least sectionally past said drive motor by way of said rotor (32) and laterally exits said inner space (24) of said housing (12) through an outlet opening (46);
a channel (41) is provided for said gaseous coolant;
said channel (41) extends around said safety vessel (26) in a helical manner at least in sub-regions and forms a U-shaped in cross-section flow guidance (40) which sectionally limits said channel (41) in a radial direction and in an axial direction so that at least in the region of said safety vessel (26) a directed flow is produced in a direction around said safety vessel (26).

2. Centrifuge (10), comprising:
a housing (12);
said housing includes an inner space (24);
a rotor (32);
a safety vessel (26);
a drive shaft (37);
a drive motor;
said rotor (32) is supported on said drive shaft (37) and extends through said safety vessel (26);
a centrifuge cover (16) limiting said inner space (24) of said housing (12);
said centrifuge cover includes a bottom wall (16*b*);
said bottom wall of said centrifuge cover includes a suction opening (20);
said safety vessel (26) resides in said inner space (24);
a gaseous coolant enters said inner space (24) through said suction opening (20) of said bottom wall of said centrifuge cover and flows through said inner space (24) and is thereby guided laterally past said safety vessel (26) and at least sectionally past said drive motor by way of said rotor (32) and laterally exits said inner space (24) of said housing (12) through an outlet opening (46);

a channel (41) is provided for said gaseous coolant;

said channel (41) extends around said safety vessel (26) in a helical manner at least in sub-regions and forms a flow guidance (40) which abuts said safety vessel (26) and sectionally limits said channel (41) in a radial direction and in an axial direction so that at least in the region of said safety vessel (26) a directed flow is produced in a direction around said safety vessel (26).

3. Centrifuge (10), comprising:

a housing (12);

said housing includes an inner space (24);

a rotor (32);

a safety vessel (26);

a drive shaft (37);

a drive motor;

said rotor (32) is supported on said drive shaft (37) and extends through said safety vessel (26);

a centrifuge cover (16) limiting said inner space (24) of said housing (12);

said centrifuge cover includes a bottom wall (16*b*);

said bottom wall of said centrifuge cover includes a suction opening (20);

said safety vessel (26) resides in said inner space (24);

a gaseous coolant enters said inner space (24) through said suction opening (20) of said bottom wall of said centrifuge cover and flows through said inner space (24) and is thereby guided laterally past said safety vessel (26) and at least sectionally past said drive motor by way of said rotor (32) and laterally exits said inner space (24) of said housing (12) through an outlet opening (46);

a channel (41) is provided for said gaseous coolant;

said channel (41) extends around said safety vessel (26) in a helical manner at least in sub-regions and forms a flow guidance (40) which sectionally limits said channel (41) in a radial direction and in an axial direction so that at least in the region of said safety vessel (26) a directed flow is produced in a direction around said safety vessel (26);

said gaseous coolant has a deepest flow course; and, said outlet opening (46) is arranged above said deepest flow course of said coolant gas when viewed in said axial direction.

4. Centrifuge (10), comprising:

a housing (12);

said housing includes an inner space (24);

a rotor (32);

a safety vessel (26);

a drive shaft (37);

a drive motor;

said rotor (32) is supported on said drive shaft (37) and extends through said safety vessel (26);

a centrifuge cover (16) limiting said inner space (24) of said housing (12);

said centrifuge cover includes a bottom wall (16*b*);

said bottom wall of said centrifuge cover includes a suction opening (20);

said safety vessel (26) resides in said inner space (24);

a gaseous coolant enters said inner space (24) through said suction opening (20) of said bottom wall of said centrifuge cover and flows through said inner space (24) and is thereby guided laterally past said safety vessel (26) and at least sectionally past said drive motor by way of said rotor (32) and laterally exits said inner space (24) of said housing (12) through an outlet opening (46);

a channel (41) is provided for said gaseous coolant;

said outlet opening (46) is arranged above said drive motor (36) for said rotor (32);

said channel (41) extends around said safety vessel (26) in a helical manner at least in sub-regions and forms a flow guidance (40) which sectionally limits said channel (41) in a radial direction and in an axial direction so that at least in the region of said safety vessel (26) a directed flow is produced in a direction around said safety vessel (26).

* * * * *